US009223330B2

(12) United States Patent
Lee

(10) Patent No.: US 9,223,330 B2
(45) Date of Patent: Dec. 29, 2015

(54) INTERNAL VOLTAGE GENERATION CIRCUIT

(71) Applicant: SK hynix Inc., Gyeonggi-do (KR)

(72) Inventor: Hyun Chul Lee, Gyeonggi-do (KR)

(73) Assignee: SK Hynix Inc., Gyeonggi-do (KR)

( * ) Notice: Subject to any disclaimer, the term of this patent is extended or adjusted under 35 U.S.C. 154(b) by 0 days.

(21) Appl. No.: 14/225,025

(22) Filed: Mar. 25, 2014

(65) Prior Publication Data

US 2015/0091541 A1 Apr. 2, 2015

(30) Foreign Application Priority Data

Sep. 30, 2013 (KR) ..... 10-2013-0116267

(51) Int. Cl.
*G05F 1/10* (2006.01)
*G05F 1/56* (2006.01)
*G05F 1/46* (2006.01)

(52) U.S. Cl.
CPC . *G05F 1/56* (2013.01); *G05F 1/465* (2013.01)

(58) Field of Classification Search
None
See application file for complete search history.

(56) References Cited

U.S. PATENT DOCUMENTS

| | | | | |
|---|---|---|---|---|
| 5,075,640 | A * | 12/1991 | Miyazawa | 331/10 |
| 5,144,156 | A * | 9/1992 | Kawasaki | 327/157 |
| 5,783,956 | A * | 7/1998 | Ooishi | 327/157 |
| 7,265,607 | B1 * | 9/2007 | Rajapandian et al. | 327/541 |
| 7,307,469 | B2 * | 12/2007 | Yamada et al. | 327/540 |
| 7,417,494 | B2 * | 8/2008 | Choi et al. | 327/541 |
| 7,443,249 | B2 * | 10/2008 | Song | 331/17 |
| 8,847,911 | B2 * | 9/2014 | Klein et al. | 345/174 |
| 2007/0069809 | A1 * | 3/2007 | Kang | 327/541 |

FOREIGN PATENT DOCUMENTS

KR 1020090110591 10/2009

* cited by examiner

*Primary Examiner* — Lincoln Donovan
*Assistant Examiner* — Khareem E Almo
(74) *Attorney, Agent, or Firm* — IP & T Group LLP

(57) ABSTRACT

An internal voltage generation circuit includes a comparison unit suitable for comparing a voltage level of a feedback voltage with that of a reference voltage, and generating a comparison signal and an acceleration voltage, a pull-up driving unit suitable for driving an internal voltage terminal to be pulled up in response to the comparison signal, a discharging unit suitable for discharging the internal voltage terminal in response to the acceleration voltage, and a voltage division unit suitable for dividing a voltage level of the internal voltage terminal, and generating the feedback voltage.

14 Claims, 2 Drawing Sheets

INTERNAL VOLTAGE GENERATION CIRCUIT

CROSS-REFERENCE TO RELATED APPLICATION

The present application claims priority under 35 U.S.C. §119(a) to Korean application number 10-2013-0116267, filed on Sep. 30, 2013, in the Korean Intellectual Property Office, which is incorporated by reference herein in its entirety.

BACKGROUND

1. Technical Field

Various embodiments relate to a semiconductor integrated circuit, and more particularly, to an internal voltage generation circuit.

2. Related Art

A semiconductor device generates and uses a voltage level for operation thereof based on an external voltage, that is, a voltage supplied from an external. The voltage generated by the semiconductor device is referred to an internal voltage. Further, a circuit, included in the semiconductor device, for generating the internal voltage is referred to as an internal voltage generation circuit.

FIG. 1 is a block diagram illustrating a conventional internal voltage generation circuit.

Referring to FIG. 1, the conventional internal voltage generation circuit includes a comparison unit 10, a pull-up driving unit 20, and a voltage division unit 30.

The comparison unit 10 compares a voltage level of a feedback voltage V_fb with that of a reference voltage Vref and generates a comparison signal Com_s.

The pull-up driving unit 20 drives a terminal for supplying an internal voltage V_int to be pulled up in response to the comparison signal Com_s.

The voltage division unit 30 divides the internal voltage V_int and provides the divided voltage as the feedback voltage V_fb that has a voltage level corresponding to the internal voltage V_int.

The conventional internal voltage generation circuit may maintain a voltage level of the internal voltage V_int at a target level by increasing the voltage level of the internal voltage V_int when the voltage level of the feedback voltage V_fb is lower than the voltage level of the reference voltage Vref.

The internal voltage V_int keeps the target level and is lowered below the target level when the internal voltage V_int is used by another internal circuit.

A semiconductor memory device as an example is described below with reference to FIG. 2.

The voltage level of the internal voltage V_int may be lowered below the target level when a command COMMAND is input to the semiconductor memory device. It is because the circuits, such as a receiver circuit for receiving the command COMMAND, a decoding circuit for decoding an output of the receiver circuit to decide what command is the command COMMAND and other internal circuits in the semiconductor memory device for performing a specific operation depending on the decoding result, consume the internal voltage V_int (i.e., a current flowing through the V_int terminal).

When the internal voltage V_int is lowered below the target level, the internal voltage generation circuit of FIG. 1 performs an operation to increase the voltage level of the internal voltage V_int that is currently below the target level. In the operation, an overshooting effect, which suggest that the voltage level of the internal voltage V_int is sharply increased to a voltage level that is higher than the target level, may occur.

When another operation (e.g., a data output operation DATA_out), which requires more power (i.e., the internal voltage V_int) than the operation corresponding to the command COMMAND, is performed in a state where the voltage level of the internal voltage V_int is higher than the target level due to the overshooting effect, the voltage level of the internal voltage V_int may be lowered more than the voltage level lowered due to the command COMMAND.

That is, when the overshooting effect occurs, the pull-up operation of the pull-up driving unit 20 is blocked, because the voltage level of the internal voltage V_int is higher than the target level due to the overshooting effect. Under such condition, if a large amount of the internal voltage V_int is rapidly consumed, it takes long time to recover the target level. Such a concern is caused by a low response speed of the comparison unit. That is, rapid consumption of an operation current in the overshooting period may cause the recovery time to be increased. Accordingly, it may be desirable to reduce the overshooting period.

SUMMARY

In an embodiment of the present invention, an internal voltage generation circuit may include a comparison unit suitable for comparing a voltage level of a feedback voltage with that of a reference voltage, and generating a comparison signal and an acceleration voltage, a pull-up driving unit suitable for driving an internal voltage terminal to be pulled up in response to the comparison signal, a discharging unit suitable for discharging the internal voltage terminal in response to the acceleration voltage, and a voltage division unit suitable for dividing a voltage level of the internal voltage terminal, and generating the feedback voltage.

In an embodiment of the present invention, an internal voltage generation circuit may include a comparison voltage generation unit suitable for generating a first comparison voltage and a second comparison voltage by comparing voltage levels of a reference voltage and a feedback voltage, a comparison signal generation unit suitable for generating a comparison signal and an acceleration voltage based on the first and second comparison voltages, a pull-up driving unit suitable for driving an internal voltage terminal to be pulled up in response to the comparison signal, a discharging unit suitable for discharging the internal voltage terminal in response to the acceleration voltage, and a voltage division unit suitable for dividing a voltage level of the internal voltage terminal, and generating the feedback voltage.

BRIEF DESCRIPTION OF THE DRAWINGS

Features, aspects, and embodiments are described in conjunction with the accompanying drawings, in which.

DETAILED DESCRIPTION

Figure 1:
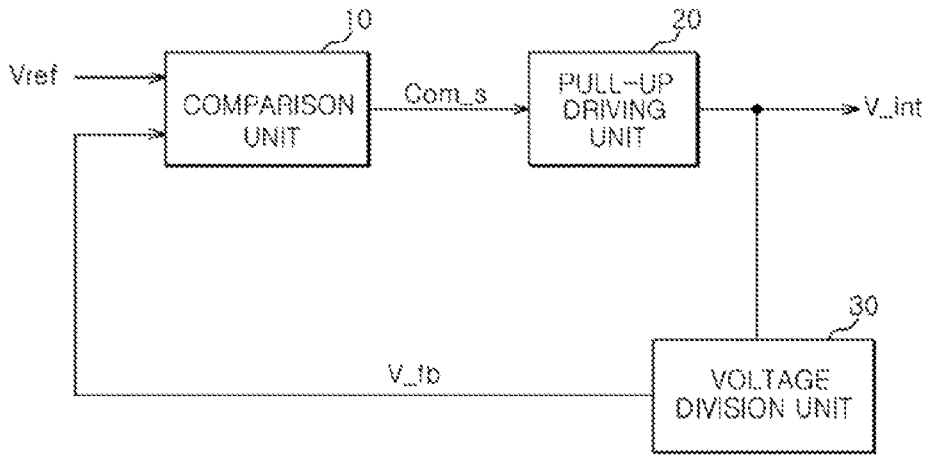
FIG.1 (PRIOR ART)
FIG. 1 is a block diagram illustrating a conventional internal voltage generation circuit.
Figure 2:
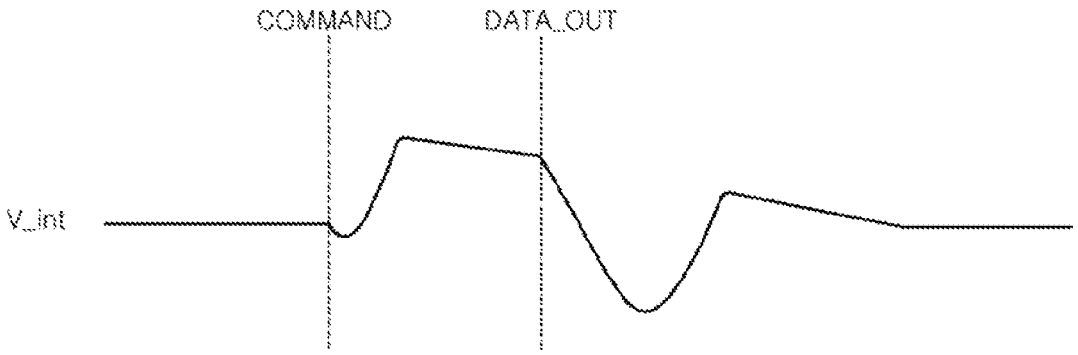
FIG.2 (PRIOR ART)
FIG. 2 is a waveform diagram for explaining an operation of the conventional internal voltage generation circuit shown in FIG. 1.

Hereinafter, a semiconductor device and a system including the same according to the present disclosure will be described below with reference to the accompanying drawings through embodiments.

Throughout the disclosure, reference numerals correspond directly to the like numbered parts in the various figures and embodiments of the present invention. It is also understood that when a layer is referred to as being "on" another layer or substrate, it can be directly on the other or substrate, or intervening layers may also be present. It is also noted that in this specification, "connected/coupled" refers to one component not only directly coupling another component but also indirectly coupling another component through an intermediate component. In addition, a singular form may include a plural form as long as it is not specifically mentioned in a sentence.

Figure 3:
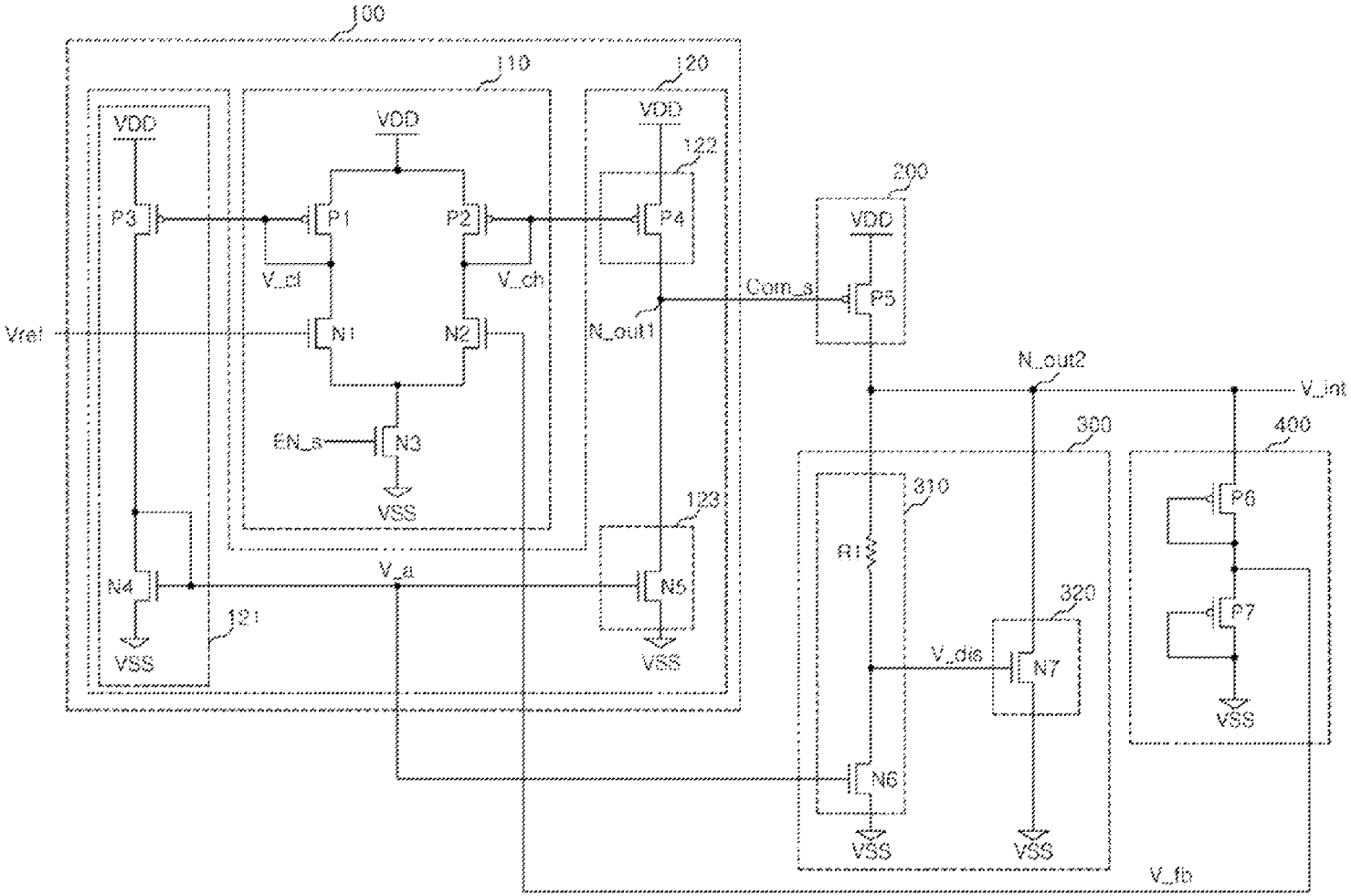
FIG. 3 is a circuit diagram illustrating an internal voltage generation circuit in accordance with an embodiment of the present invention.

FIG. 3 is a circuit diagram illustrating an internal voltage generation circuit in accordance with an embodiment of the present invention.

Referring to FIG. 3, the internal voltage generation circuit may include a comparison unit 100, a pull-up driving unit 200, a discharging unit 300 and a voltage division unit 400.

The comparison unit 100 may compare voltage levels of a feedback voltage V_fb with that of a reference voltage Vref and generate a comparison signal Com_s and an acceleration voltage V_a. For example, the comparison unit 100 may activate the comparison signal Com_s and increase a voltage level of the acceleration voltage V_a when the voltage level of the feedback voltage V_fb is lower than the voltage level of the reference voltage Vref. The comparison unit 100 may deactivate the comparison signal Com_s and decrease the voltage level of the acceleration voltage V_a when the voltage level of the feedback voltage V_fb is higher than the voltage level of the reference voltage Vref.

Further, the comparison unit 100 may include a comparison voltage generation unit 110 and a comparison signal generation unit 120.

The comparison voltage generation unit 110 may compare voltage levels of the reference voltage Vref and the feedback voltage V_fb and generate first and second comparison voltages V_cl and V_ch. For example, the comparison voltage generation unit 110 may lower the voltage level of the first comparison voltage V_cl below the voltage level of the second comparison voltage V_ch when the voltage level of the feedback voltage V_fb is lower than the voltage level of the reference voltage Vref. The comparison voltage generation unit 110 may raise the voltage level of the first comparison voltage V_cl over the voltage level of the second comparison voltage V_ch when the voltage level of the feedback voltage V_fb is higher than the voltage level of the reference voltage Vref.

The comparison voltage generation unit 110 may include first to fifth transistors (e.g. MOS transistors) N1, N2, N3, P1 and P2. The first transistor N1 may receive the reference voltage Vref at its gate. The second transistor N2 may receive the feedback voltage V_fb at its gate. The third transistor N3 may receive an enable signal' EN_s at its gate and may be coupled to each source of the first and second transistors N1 and N2 at its drain and to a ground voltage terminal VSS at its source. The fourth transistor P1 may be coupled to the drain of the first transistor N1 at its drain and to the drain of itself at its gate and may receive an external voltage VDD at its source. The fifth transistor P2 may be coupled to the drain of the second transistor N2 at its drain and to the drain of itself at its gate and may receive the external voltage VDD at its source. A voltage at a node to which the first transistor N1 and the fourth transistor P1 are coupled is the first comparison voltage V_cl, and a voltage at a node to which the second transistor N2 and the fifth transistor P2 are coupled is the second comparison voltage V_ch.

The comparison signal generation unit 120 may generate the acceleration voltage V_a and the comparison signal Com_s based on the first and second comparison voltage V_cl and V_ch. For example, the comparison signal generation unit 120 may activate the comparison signal Com_s when the voltage level of the first comparison voltage V_cl is higher than the voltage level of the second comparison voltage V_ch. The comparison signal generation unit 120 may deactivate the comparison signal Com_s when the voltage level of the first comparison voltage is lower than the voltage level of the second comparison voltage V_ch. Further, the comparison signal generation unit 120 may generate the acceleration voltage V_a, the voltage level of which is in inverse proportion to the voltage level of the first comparison voltage V_cl. For example, the comparison signal generation unit 120 may lower the voltage level of the acceleration voltage as the voltage level of the first comparison voltage V_cl is increased, and may raise the voltage level of the acceleration voltage V_a as the voltage level of the first comparison voltage V_cl is lowered. The comparison signal generation unit 120 may shorten a transition time in which the deactivated comparison signal Com_s becomes activated when the voltage level of the acceleration voltage V_a becomes higher. Further, the comparison signal generation unit 120 may shorten a transition time in which the activated comparison signal Com_s becomes deactivated when the voltage level of the acceleration voltage V_a becomes lower.

The comparison signal generation unit 120 may include an acceleration voltage generation unit 121, a disable unit 122, and an enable unit 123.

The acceleration voltage generation unit 121 may lower the voltage level of the acceleration voltage V_a as the voltage level of the first comparison voltage V_cl is increased, and may raise the voltage level of the acceleration voltage V_a as the voltage level of the first comparison voltage is lowered.

The acceleration voltage generation unit 121 may include sixth and seventh transistor P3 and N4. The sixth transistor P3 may receive the first comparison voltage V_cl at its gate and the external voltage VDD at its source. The seventh transistor N4 may be coupled to a drain of the sixth transistor P3 at its drain, to a drain of itself at its gate and to the ground voltage terminal VSS at its source. A voltage at a node to which the gate and drain of the seventh transistor N4 are coupled is the acceleration voltage V_a.

The disable unit 122 may raise the voltage level of a first output node N_out1 in response to the voltage level of the second comparison voltage V_ch. For example, the disable unit 122 may raise the voltage level of the first output node N_out1 as the voltage level of the second comparison voltage V_ch is lowered. The comparison signal Com_s may be output through the first output node N_out1.

The disable unit 122 may include an eighth transistor P4. The eighth transistor P4 may receive the second comparison voltage V_ch at its gate and the external voltage VDD at its source and may be coupled to the first output node N_out1 at its drain.

The enable unit 123 may lower the voltage level of the acceleration voltage V_a. For example, the enable unit 123 may lower the voltage level of the first output node N_out1 as the voltage level of the acceleration voltage V_a is increased.

The enable unit 123 may include a ninth transistor N5. The ninth transistor N5 may receive the acceleration voltage V_a at its gate and may be coupled to the first output node N_out1 at its drain and to the ground voltage terminal VSS at its source.

The voltage level of the acceleration voltage V_a may be lowered when the voltage level of the first comparison voltage V_cl is higher than the voltage level of the second comparison voltage V_ch.

The disable unit 122 may raise the voltage level of the first output node N_out1 due to the lowered second comparison voltage V_ch. The eighth transistor P4 of the disable unit 122 may raise the voltage level of the first output node N_out1 by transferring more amount of current to the first output node N_out1.

Meanwhile, as the voltage level of the acceleration voltage V_a is lowered, a degree of turn-off of the ninth transistor N5 of the enable unit 123 is reduced, and thus an amount of current flowing from the first output node N_out1 to the ground voltage terminal VSS is decreased.

Therefore, the voltage level of the first output node N_out1 may be increased rapidly due to the increased sourcing current flowing through the disable unit 122 and decreased sinking current flowing through the enable unit 123. Since the voltage level of the first output node N_out1 corresponds to the voltage level of the comparison signal Com_s, the comparison signal Com_s may shift to a logic high level rapidly as the voltage level of the first output node N_out1 is raised rapidly. In other words, the comparison signal Com_s becomes deactivated rapidly to a logic high level.

On the other hand, the voltage level of the acceleration voltage V_a may be raised when the voltage level of the first comparison voltage V_cl is lower than the voltage level of the second comparison voltage V_ch.

As the voltage level of the second comparison voltage V_ch is raised, a degree of turn-on of the eighth transistor P4 of the disable unit 122 is reduced, and thus an amount of current flowing from the disable unit 122 to the first output node N_out1 is decreased.

The enable unit 123 may allow amount of current flowing from the first output node N_out1 to the ground voltage terminal VSS to become greater. In other words, the enable unit 123 may lower the voltage level of the first output node N_out1 as the voltage level of the acceleration voltage V_a is increased.

Therefore, the voltage level of the first output node N_out1 may be lowered rapidly due to the decreased sourcing current flowing through the disable unit 122 and decreased sinking current flowing through the enable unit 123. Since the voltage level of the first output node N_out1 corresponds to the voltage level of the comparison signal Com_s, the comparison signal Com_s may shift rapidly to a logic level as the voltage level of the first output node N_out1 is lowered rapidly. In other words, the comparison signal Com_s becomes activated rapidly to a logic low level.

The pull-up driving unit 200 may raise the voltage level of the internal voltage V_int by driving a second output node N_out2 (i.e., an internal voltage terminal) to be pulled up in response to the comparison signal Com_s.

The pull-up driving unit 200 may include a tenth transistor P5. The tenth transistor P5 may receive the comparison signal Com_s at its gate and the external voltage VDD at its source and may be coupled to the second output node N_out2 at its drain. For example, the tenth transistor P5 may drive the second output node N_out2 when the comparison signal Cam_s is activated to a logic low level.

The discharging unit 300 may discharge the second output node N_out2 in response to the voltage level of the acceleration voltage V_a. For example, the more the voltage level of the acceleration voltage V_a is lowered, the more the discharging unit 300 may lower the voltage level of the internal voltage V_int.

The discharging unit 300 may include a drop voltage generation unit 310 and a voltage drop unit 320.

The drop voltage generation unit 310 may generate a drop voltage V_dis based on the acceleration voltage V_a. For example, the drop voltage generation unit 310 may lower the voltage level of the drop voltage V_dis as the voltage level of the acceleration voltage V_a is increased, and may raise the voltage level of the drop voltage V_dis as the voltage level of the acceleration voltage V_a is lowered.

The drop voltage generation unit 310 may include a resistive element (e.g., a resistor) R1 and a eleventh transistor (e.g., an NMOS transistor) N6. The resistive element R1 may be coupled to the second output node N_out2. The eleventh transistor N6 may be coupled to the resistive element R1 at its drain and to the ground voltage terminal VSS at its source and may receive the drop voltage V_dis at its gate. The drop voltage V_dis may be generated from a node to which the resistive element R1 and the eleventh transistor N6 are coupled.

As the voltage level of the drop voltage V_dis is increased, the voltage drop unit 320 may discharge the second output node N_out2. That is, the more the voltage level of the drop voltage V_dis is lowered, the more the voltage drop unit 320 may lower the voltage level of the internal voltage V_int.

The voltage drop unit 320 may include a twelfth transistor (e.g., an NMOS transistor) N7. The twelfth transistor N7 may receive the drop voltage V_dis at its gate and may be coupled to the second output node N_out2 at its drain and to the ground voltage terminal VSS at its source.

The voltage division unit 400 may generate the feedback voltage V_fb that has a voltage level lower than the voltage level of the internal voltage V_int by dividing the internal voltage V_int with a predetermined division ratio.

The voltage division unit 400 may include thirteenth and fourteenth transistors (e.g., diode-coupled PMOS transistors) P6 and P7. The thirteenth transistor P6 may be coupled to the second output node N_out2 at its source and a gate of itself at its drain. The fourteenth transistor P7 may be coupled to the drain of the thirteenth transistor P6 at its source and a gate of itself at its drain coupled to the ground voltage terminal VSS.

An operation of the internal voltage generation circuit is described as follows.

First case describes when the voltage level of the internal voltage V_int is lowered below the target level.

In such case, the voltage level of the feedback voltage V_fb is lower than the voltage level of the reference voltage Vref, and thus the voltage level of the first comparison voltage V_cl may be lowered and the voltage level of the second comparison voltage V_ch may be raised. In other words, the voltage level of the first comparison voltage V_cl may become lower than the voltage level of the second comparison voltage V_ch.

The voltage level of the acceleration voltage V_a may be raised as the voltage level of the first comparison voltage V_cl is lowered.

The amount of current transferred to the first output node N_out1 by the disable unit 122 may decrease as the voltage level of the second comparison voltage V_ch is raised.

As the voltage level of the acceleration voltage V_a is raised, the amount of current flowing from the first output node N_out1 to the ground voltage terminal VSS by the enable unit 123 may be increased.

Therefore, the voltage level of the first output node N_out1 may become lower, and the comparison signal Com_s may be activated to a logic low level.

The pull-up driving unit 200 may raise the voltage level of the internal voltage V_int when the comparison signal Com_s is activated to a logic low level.

When the voltage level of the drop voltage V_dis is lowered due to the increased acceleration voltage V_a, the voltage drop unit 320 may lessen the amount of discharging current flowing from the second output node N_out2, which is the output node of the internal voltage V_int, to the ground voltage terminal VSS.

Therefore, the internal voltage V_int may be raised and recover the target level.

Second case describes the voltage level of the internal voltage V_int is increased beyond the target level.

In such case, the voltage level of the feedback voltage V_fb is higher than the voltage level of the reference voltage Vref, and thus the voltage level of the first comparison voltage V_cl may be raised and the voltage level of the second comparison voltage V_ch may be lowered. In other words, the voltage level of the first comparison voltage V_cl may become higher than the voltage level of the second comparison voltage V_ch.

The voltage level of the acceleration voltage V_a may be lowered as the voltage level of the first comparison voltage V_cl is increased.

The amount of current transferred to the first output node N_out1 by the disable unit 122 may become greater as the voltage level of the second comparison voltage V_ch is lowered.

As the voltage level of the acceleration voltage V_a is lowered, the amount of current flowing from the first output node N_out1 to the ground voltage terminal VSS by the enable unit 123 may decrease.

Therefore, the voltage level of the first output node N_out1 may become higher, and the comparison signal Com_s may be deactivated to a logic high level.

The pull-up operation of the pull-up driving unit 200 may be blocked when the comparison signal Com_s is deactivated to a logic high level.

When the voltage level of the drop voltage V_dis is increased due to the lowered acceleration voltage V_a the voltage drop unit 320 may sharply increase the amount of current flowing from the second output node N_out2, which is the output node of the internal voltage V_int, to the ground voltage terminal VSS.

Therefore, the internal voltage V_int may be lowered and reach the target level rapidly.

The internal voltage generation circuit in accordance with the embodiment of the present invention may shorten a transition time of the comparison signal by generating the first and second comparison voltages based on the voltage levels of the reference voltage and the feedback voltage through the comparison unit and deciding the activation and the inactivation of the comparison signal using the voltage levels of the first and second comparison voltages. In other words, the internal voltage generation circuit may shorten a response time taken to compare the reference voltage and the feedback voltage and generate the comparison signal. Also, when the internal voltage is lower than the target voltage, the internal voltage generation circuit may lower the voltage level of the internal voltage when the internal voltage is higher than the target voltage and raise the voltage level of the internal voltage, because the internal voltage generation circuit may generate the internal voltage by using the pull-up driving unit and the discharging unit that may raise and lower the internal voltage. Further, when the internal voltage becomes higher, for example, when an overshooting effect occurs, the internal voltage generation circuit may lower more rapidly the voltage level of the internal voltage due to the acceleration voltage, which may be generated faster than the comparison signal that is generated based on the comparison between the reference voltage and the feedback voltage.

While certain embodiments have been described above, it will be understood to those skilled in the art that these embodiments have been described for illustrative purposes. Accordingly, the internal voltage generation circuit described herein should not be limited to the described embodiments. Rather, the internal voltage generation circuit described herein should be understood in light of the following claims.

What is claimed is:

1. An internal voltage generation circuit comprising:

a comparison unit suitable for generating a comparison signal and an acceleration voltage by comparing a voltage level of a feedback voltage with that of a reference voltage;

a pull-up driving unit suitable for receiving the comparison signal and driving an internal voltage terminal to be pulled up in response to the comparison signal;

a discharging unit suitable for receiving the acceleration voltage and discharging the internal voltage terminal, driven by the pull-up driving unit, in response to the acceleration voltage; and a voltage division unit suitable for dividing a voltage level of the internal voltage terminal, and generating the feedback voltage, wherein a transition time of the comparison signal is controlled depending on the acceleration voltage.

2. The internal voltage generation circuit of claim 1, wherein:

when the voltage level of the feedback voltage is lower than that of the reference voltage, the comparison signal is activated, and the acceleration voltage is increased, and when the voltage level of the feedback voltage is higher than that of the reference voltage, the comparison signal is deactivated, and the acceleration voltage is decreased.

3. The internal voltage generation circuit of claim 2, wherein:

when the voltage level of the acceleration voltage becomes higher, the comparison unit shortens a first transition time in which the deactivated comparison signal becomes activated, and when the voltage level of the acceleration voltage becomes lower, the comparison unit shortens a second transition time in which the activated comparison signal becomes deactivated.

4. The internal voltage generation circuit of claim 2, wherein the more the acceleration voltage becomes low, the more the discharging unit discharges the internal voltage terminal.

5. The internal voltage generation circuit of claim 4, wherein the discharging unit comprises:

a drop voltage generation unit suitable for generating a drop voltage based on the acceleration voltage; and a voltage drop unit suitable for discharging the internal voltage terminal in response to the drop voltage.

6. The internal voltage generation circuit of claim 5, wherein the drop voltage generation unit lowers the voltage level of the drop voltage as the voltage level of the acceleration voltage is increased, and raises the voltage level of the drop voltage as the voltage level of the acceleration voltage is lowered.

7. The internal voltage generation circuit of claim 5, wherein the more the drop voltage is lowered, the more the voltage drop unit discharges the internal voltage terminal.

8. An internal voltage generation circuit comprising:

a comparison voltage generation unit suitable for generating a first comparison voltage and a second comparison voltage by comparing voltage levels of a reference voltage and a feedback voltage;

a comparison signal generation unit suitable for generating a comparison signal and an acceleration voltage based on the first and second comparison voltages;

a pull-up driving unit suitable for receiving the comparison signal and driving an internal voltage terminal to be pulled up in response to the comparison signal;

a discharging unit suitable for receiving the acceleration voltage and discharging the internal voltage terminal, driven by the pull-up driving unit, in response to the acceleration voltage; and a voltage division unit suitable for dividing a voltage level of the internal voltage terminal, and generating the feedback voltage, wherein the comparison signal generation unit controls a transition time of the comparison signal in response to the acceleration voltage.

9. The internal voltage generation circuit of claim 8, wherein:

when the voltage level of the feedback voltage is lower than that of the reference voltage, the voltage level of the first comparison voltage is lowered below the voltage level of the second comparison voltage, and when the voltage level of the feedback voltage is higher than that of the reference voltage, the voltage level of the first comparison voltage is increased beyond that of the second comparison voltage.

10. The internal voltage generation circuit of claim 9, wherein:

when the voltage level of the first comparison voltage is lower than the voltage level of the second comparison voltage, the comparison signal is activated, and when the voltage level of the first comparison voltage is higher than that of the second comparison voltage, the comparison signal is deactivated.

11. The internal voltage generation circuit of claim 8, wherein the more the acceleration voltage becomes low, the internal voltage terminal the more the discharging unit discharges the internal voltage terminal.

12. The internal voltage generation circuit of claim 11, wherein the discharging unit comprises:

a drop voltage generation unit coupled to the internal voltage terminal, and suitable for generating a drop voltage based on the acceleration voltage; and a voltage drop unit coupled between the internal voltage terminal and a ground voltage terminal, and suitable for controlling an amount of discharging current flowing from the internal voltage terminal to the ground voltage terminal in response to the drop voltage.

13. The internal voltage generation circuit of claim 12, wherein the drop voltage generation unit comprises:

a resistive element, coupled between the internal voltage terminal and a node, suitable for outputting the drop voltage; and a PMOS transistor, coupled between the node and the ground voltage terminal, suitable for receiving the acceleration voltage as a gate input.

14. The internal voltage generation circuit of claim 13, wherein the voltage drop unit comprises:

an NMOS transistor coupled between the internal voltage terminal and the ground voltage terminal and suitable for receiving the drop voltage as a gate input.

* * * * *